United States Patent [19]

Iizuka et al.

[11] Patent Number: 5,009,070

[45] Date of Patent: Apr. 23, 1991

[54] COMBUSTION APPARATUS FOR GAS TURBINE

[75] Inventors: Nobuyuki Iizuka; Fumiyuki Hirose, both of Hitachi; Naotatsu Asahi, Katsuta; Yoshitaka Kojima, Hitachi, all of Japan

[73] Assignee: Hitachi, Ltd., Tokyo, Japan

[21] Appl. No.: 36,181

[22] Filed: Apr. 9, 1987

Related U.S. Application Data

[63] Continuation of Ser. No. 946,775, Dec. 29, 1986, abandoned, which is a continuation of Ser. No. 690,190, Jan. 10, 1985, abandoned.

[30] Foreign Application Priority Data

Jan. 13, 1984 [JP] Japan ..... 59-3474

[51] Int. Cl.[5] ..... F02G 3/00

[52] U.S. Cl. ..... 60/753; 60/39.55

[58] Field of Search ..... 60/39.55, 753, 756; 415/214; 416/241 B; 428/632; 427/34, 423

[56] References Cited

U.S. PATENT DOCUMENTS

| | | | |
|---|---|---|---|
| 3,831,854 | 8/1974 | Sato et al. | 60/756 |
| 4,055,705 | 10/1977 | Stecura et al. | 427/34 X |
| 4,248,940 | 2/1981 | Gouard et al. | 427/34 X |
| 4,429,019 | 1/1984 | Schrewelius | 416/241 B |

*Primary Examiner*—Louis J. Casaregola
*Assistant Examiner*—T. S. Thorpe
*Attorney, Agent, or Firm*—Antonelli, Terry, Stout & Kraus

[57] ABSTRACT

A surface, of an inner sleeve of a combustion apparatus for a gas turbine, which is subjected to a flame radiation heat is coated with a ceramic coating. A coating which is superior in high temperature corrosion resistant characteristics to a metal material forming the inner sleeve is provided on the opposite surface of the inner sleeve. Thus, heat transferred to the inner sleeve by the radiation from the flame is shielded by the ceramic coating. A formation of oxides on the coating of the corrosion resistant metal material formed on the opposite surface of the sleeve is prevented. A heat release through the surface from the metal material forming the inner sleeve is enhanced, whereby a thermal stress generated in the inner sleeve is suppressed to thereby prevent a generation of a cracks.

5 Claims, 5 Drawing Sheets

COMBUSTION APPARATUS FOR GAS TURBINE

This application is a continuation of application Ser. No. 946,775, filed Dec. 29, 1986, which is a continuation of Ser. No. 690,190, filed Jan. 10, 1985, both now abandoned.

BACKGROUND OF THE INVENTION

The present invention relates to a combustion apparatus for gas turbines and, more particularly, to a combustion apparatus having excellent durability.

In a gas turbine apparatus for use in electric power plants, there has been a demand to cope reduce pollution by reducing, harmful components contained in exhaust gas. It has been proposed to inject water or steam into the combustion chamber to reduce nitrogen oxides NOx.

In the combustion apparatus where water or steam is injected for the purpose of reducing NOx, various problems are raised in comparison with the case where the water injection is not utilized.

A water injection nozzle is generally combined with a burner for normally feeding fuel. One problem relating to water injection occurs at a liner cap member connecting the burner and a combustion apparatus liner body. Since a part of the water spray is introduced into the combustion gas but a portion of the water spray also enters into the through a spacing and holes formed in the liner cap member for cooling air. The introduction of water through the air cooling holes adversely affects the liner cap member, thereby reducing the service life of the liner cap member. More particularly, when water droplets from the water injection adheres to the metal members which are subjected to direct radiated heat of the combustion flame, the metal members are locally subjected to very large thermal stress, causing a cracking therein.

SUMMARY OF THE INVENTION

The aim underlying the present invention essentially resides in providing a combustion apparatus having a long service life in which water is injected but which prevents the formation of generation of cracks.

Various aspects of a liner cap with a water injection nozzle having been studied and it has been determined that a thermal stress is hardly generated in a liner cap, that is, the local temperature elevation is hardly raised. As a result, it has been determined that it is possible to prevent a heat entrance from the combustion gas flame to a member, and the change in a temperature gradient caused by water colliding against the member maintained at a high temperature, and the generation of heat resistance against the cooling effect due to a change in surface condition of the member.

It has also been determined that any of the above noted problems may be solved by applying a surface treatment to a liner cap member. More particularly, it has been experimentally confirmed that a crack of the combustion apparatus is generated not only by simply abrupt cooling due to water injection but also by cooling with water in a case where the members are locally expressively heated. Thus, it has been found that a crack may be prevented from being generated by eliminating the local excessive heating.

The present invention is characterized in that in order to reduce the adverse effects of radiation heat from the combustion flame, a ceramic coating is provided on one surface of a member and in order to prevent a generation of oxides adversely affecting a distribution of the air cooling, a coating made of corrosion resisting material is provided on the other surface.

BRIEF DESCRIPTION OF THE DRAWINGS

FIG. 2 is a partial cross-sectional view of a liner cap portion of a combustion apparatus to which the present invention is applied;

FIG. 3 is an enlarged cross-sectional view of a part III of FIG. 2;

DETAILED DESCRIPTION OF THE INVENTION

Figure 1:
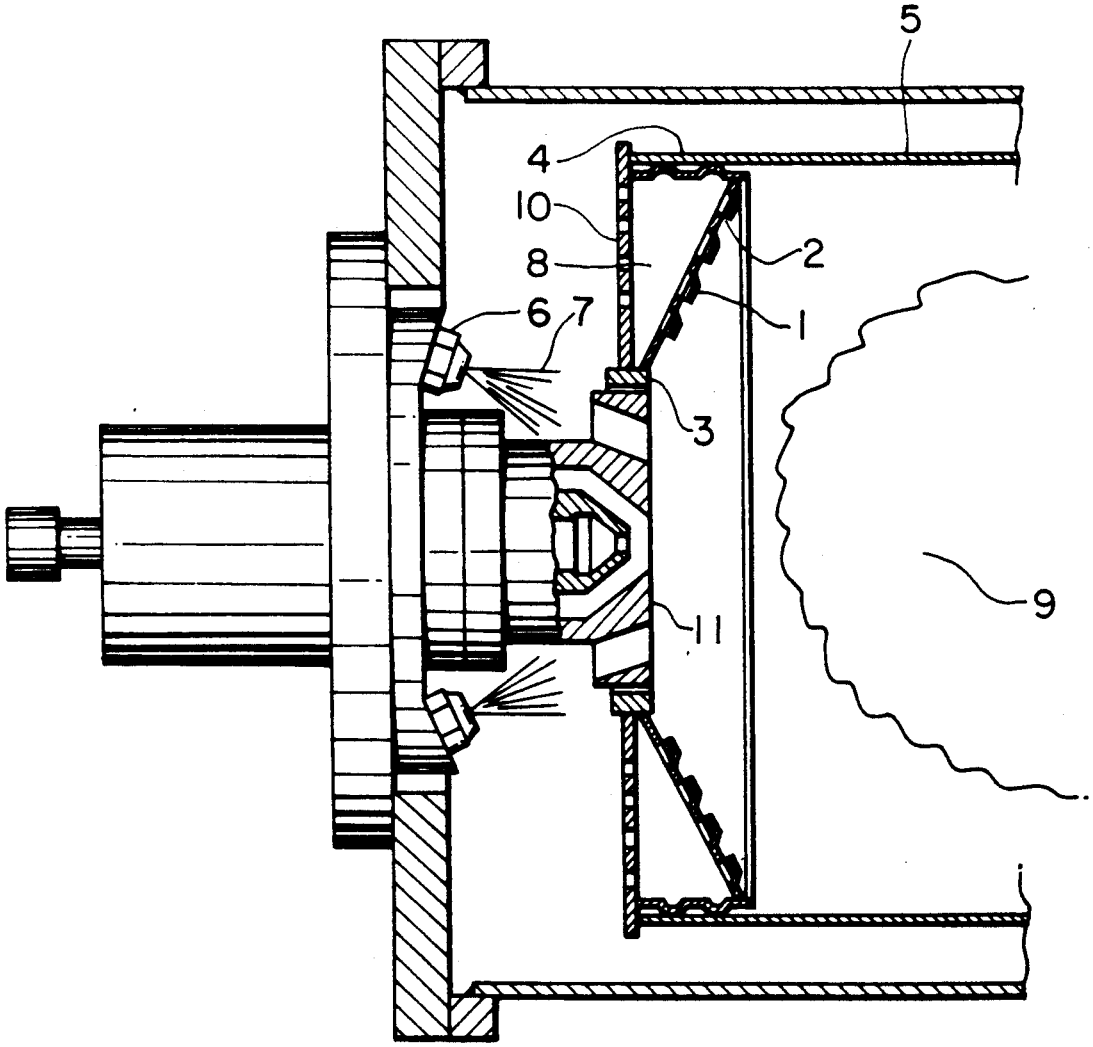
FIG. 1 is a partial cross-sectional view of a combustion apparatus.

Referring now to the drawings wherein like reference numerals are used throughout the various views to designate like parts and, more particularly, to FIG. 1, according to this FIG., a liner cap generally designated by the reference numeral 10 includes an outer cap ring 4 extending from an end plate 14 having apertures or holes 15 therein, a collar 3, and a cone portion 1.

In the combustion apparatus of FIG. 1, the cone portion 1 is not directly contacted by a combustion flame 9 but rather is heated at a high temperature by heat radiated by the combustion flame 9. A plurality of small cooling air holes are formed in the cone portion 1 for generating an air cooling effect by an air flow introduced through holes 15 in the end plate 14 and through the small cooling holes 2. A fuel burner 11 is inserted into the collar 3 and the cap ring 4 is inserted into a liner sleeve body 5. With a fuel burner provided with water spray nozzles 6, water 7 is directly introduced into the combustion flame 9 through a space 8 and the small cooling air holes 2. However, the direct introduction of water is not uniformly generated along a circumferential direction of the liner cap 10 but tends to be locally generated. Therefore, in the liner cap 10, there is an influence of the water to be introduced from the water spray nozzle 6, as well as the temperature elevation caused by radiated heat from the combustion gas flame and the cooling effect caused by the cooling air.

The liner cap 10 is constructed so that a suitable balanced temperature condition may be maintained between the radiation heat from the flame and the cooling air. However, the balanced temperature of the liner 10 is dramatically affected by the introduction of water from the water spray nozzles 6. More particularly, water from the spray nozzles 6 collides with and temporarily adheres to the liner cap 10 so that a temperature there at is abruptly reduced. In a situation wherein the water collides only with some circumferentially spaced portions of the liner cap 10, the temperature thereat is considerably reduced as compared with other parts of the liner cap 10. Such temporary temperature reduction or local temperature reductions cause a thermal stress to be produced in the components forming the liner cap 10. More particularly, the generation of a thermal stress is considerable at the cone portion 1 at which the radiation from the combustion flame 9 is directly applied. Moreover, the cone portion 1 is likely to be subjected to a stress concentration because of a provision of the plurality of the small cooling air holes 2.

Moreover, damages such as cracks are likely to be generated in the corrosion resisting member forming a portion of the liner cap 10 due to the thermal stress in a vicinity of the opening edges of the small cooling air holes 2. If the damages caused by the cracks is significant, the liner cap 10 breaks, with broken pieces of the liner cap 10 being diffused thereby causing serious damage to blades and nozzles positioned downstream of the liner of the combustion apparatus.

In, for example, conventional methods of preventing damage to the liner cap due to thermal stress, it has been proposed to modify the structure of the water spray nozzles or alter the shape of the opening edges of the small cooling air holes. However, it has not been possible to obtain satisfactory results by any of these conventional proposals due to the complicated structure or shape of the liner cap.

As described above, a problem in encountered in conventional low NOx type water spray combustion apparatus is caused by the influence of the water mixed from the water spray nozzle 6. In other words, in the case where the water abruptly collides with a part of the liner cap 10 which is contact with the combustion gas and heated at a high temperature, or locally generated in the liner cap, a temperature gradient is generated in metallic members constituting the liner cap 10, thereby causing a thermal stress. The part of the liner cap 10 in contact with the combustion gas is provided with a plurality of the small cooling air holes and is likely to be subjected to a stress concentration. Therefore, if the thermal stress is generated in the metallic members, then a considerably high stress concentration will be generated in the metallic members of the liner cap 10. If the stress concentration exceeds a mechanical strength limit of the material of the metallic members, then the metallic members will break. Additionally, it should be noted that there is a high temperature oxidation of the liner cap member due to the influence of the water supplied from the water spray nozzles; and that a generation of the thermal resistance against the cooling effect of the member with the cooling air occurs due to the deterioration of the surface condition of the member by virtue of impurities in the water adhering to the member. Thus, the cooling effect will be decreased so that a temperature of the member will be increased. If the water from the water spray nozzles is concentrated locally on the liner cap 10, the generation of the thermal resistance against the cooling effect will cause the temperature of the member to be locally increased, to generate a thermal stress in the member. On the other hand, the water from the water spray nozzles is introduced into the combustion gas from the cooling air introduction holes, contacting with the combustion gas, of the liner cap, an amount of the introduced air from the cooling air introduction holes is decreased, to change an air/fuel ratio of the gas combustion, so that the combustion flame approaches a surface of the liner cap 10. If the influence of the water is generated locally at a restricted part of the plurality of cooling air holes, a change of the combustion condition is also locally generated so that the liner cap 10 is locally heated to a higher temperature to cause a thermal stress in the member. As described above, in any case, the influence of the water from the water spray nozzles leads to the generation of the thermal stress in the member so that the member will be damaged where the stress concentration is generated. Accordingly, it preferable to avoid the generation ,of the thermal stress in the liner cap 10 to thereby prevent damage to the liner cap of the low NOx type combustion apparatus using the water spray nozzles.

According to the present invention, in a combustion apparatus for a gas turbine, the cone portion 1 of the liner cap 10 in contact with the combustion gas is most likely to be damaged and, consequently, is subjected to a surface treatment. In general, as to a member used under a high temperature condition in a high temperature gas turbine or the like, a ceramic coating is carried out as a method of preventing the temperature of the member from being increased. Such a ceramic coating is carried out on gas turbine members such as a combustion chamber liner body, blades, nozzles and the like. For any of the members, the ceramic coating is applied thereto as a method for compensating for a part where the cooling effect by the air is insufficient and for decreasing the temperature of the material forming the member. Such a coating is a so called heat shielding coating and is mainly composed of $ZrO_2$. In a normal combustion apparatus liner without any water spray, a temperature of the liner cap 10 is in a low range of between 400° to 500° C. which is lower than a durable temperature of about 700° to 800° C. of the material forming the member, and hence, a special surface treatment such as heat shielding coating is not applied. Thus, no surface treatment has been applied to the liner cap. Also, the ceramic coating applied to the combustion chamber liner, the blades, the nozzles and the like is used for compensating for the insufficient air cooling effect. Such a conventional ceramic coating has not been applied under a condition of a water supply. Also, there has not been an example for demonstrating an effect of the coating under a condition of the water supply. Rather than such an effect, it has been considered that the ceramic coating is undesirable in the part where the water is applied, in view of an enhancement of a durability of the ceramic coating. Under such a technical background, were conducted with respect various tests and studies to liner caps to which various coatings including the conventional coating are applied, and it has been determined that a a liner cap for a low NOx type combustion apparatus provided with water spray nozzles as described more fully hereinbelow is superior in durability.

The main advantages of the surface treatment layer of the liner cap for a combustion apparatus constructed in accordance with the present invention are, first, the prevention of local temperature elevation in a member due to the heat introduction from the combustion gas flame, and second, reduction of the thermal shock to the member due to the collision of water to the member supplied from the water spray nozzles. The first advantage can be realized by a combustion side surface of the member contacting the combustion gas and the second advantage may be obtained by an opposite liner cap surface that is, a cooling side surface contact the combustion gas. Thus, in accordance with the liner cap of the present invention, surface treatments for obtaining the above noted advantages are applied to both the combustion side surface and the cooling side surface. It is a feature of the present invention that when a rapid thermal change from the outside is applied to a member maintained at an equilibrium temperature under the condition that no introduction of water from the water spray nozzle is present, such an influence is suppressed and the temperature of equilibrium is not rapidly altered.

It is possible to realize the suppression effect of the temperature change of the member due to thermal change from the outside by forming a coating of material having a low heat conductivity so as to reduce a thermal diffusion in the thickness direction of the coating thereby reducing the amount of introduced heat to the member with the temperature of the coating being elevated. Such a structure is available for suppressing a thermal change of the member when the combustion gas flame or the like approaches the member considerably or abnormally as compared with a normal combustion position.

On the other hand, a coating of material having a high heat conductivity is formed on the opposite side surface of the member so that the heat diffusion is accelerated in the lateral direction in the coating as well as in the thickness direction of the coating thereby preventing a local cooling of the member. Such coatings are available as a method for suppressing a thermal change of the member which occurs, for example, when water is caused to abruptly and locally collide with the member, namely, the former suppression effect is available for the combustion side surface of the liner cap and the latter suppression effect is available for the cooling side surface.

Figure 4:
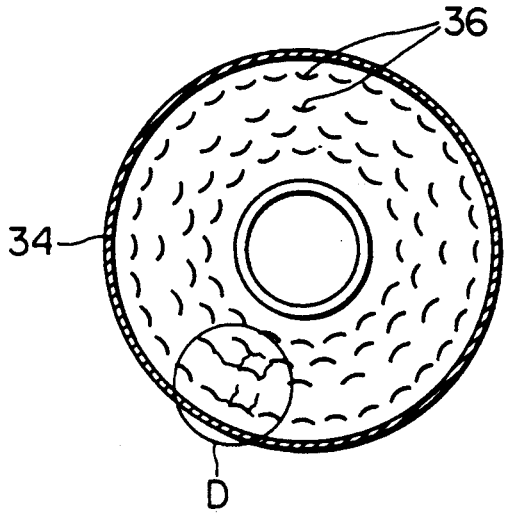
FIG. 4 is a frontal view taken in the direction of the arrow IV shown in FIG. 2.
Figure 5:
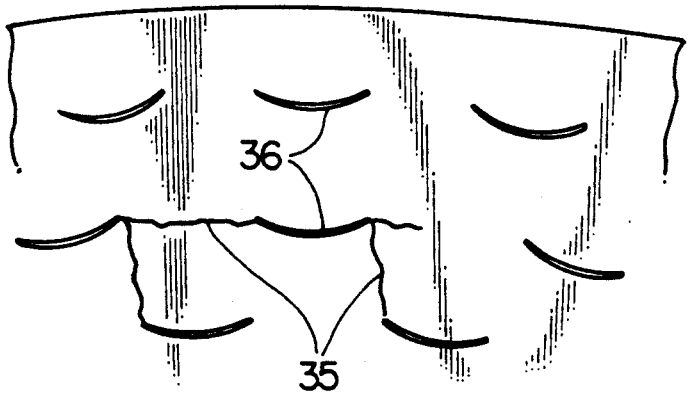
FIG. 5 is an enlarged detail view of a part D of in FIG. 4.

As shown in FIG. 2 a liner cap generally designated by the reference numeral 33 for a low NOx type combustion apparatus in accordance with the present invention includes a cap ring 26 and a cone portion 27. The liner cap 33 was made of Hastelloys-X or the like and a coating 21 made of alloy material, as shown in FIG. 3, was formed on the entire surface of a cooling side surface 20*a*, of a cone 20 of the liner cap 33 to be exposed in the combustion gas flame. The coating 21 was formed by a plasma spray welding method. The detail of the formation of the coating was as follows. First of all, prior to carrying out the spray welding, as a pre-treatment, a part to which the spray welding was to be applied was cleaned with solvent to remove oil components therefrom. Thereafter, an adhesive glass tape was attached to a part 22 to which a welding operation was to be applied in a later process, and further, a silicone rubber was applied thereto from above. Such a masking process for avoiding the influence of the spray welding was carried out. Thereafter, a blast process was applied to the part to be welded, thereby removing the oxide coating or the like from the surface of the member to clean the surface, and further, the surface was roughened. The blast condition was such that alumina grit having a diameter of about 0.7 mm was used and a pressure of air for spraying the grit was about 5 $Kg/cm^2$. Incidentally, as the blast process for the small cooling air holes 23 shown in FIG. 2, a blast was applied up to inner portions 24 shown in the enlarged cross-sectional view of the small hole 23 of FIG. 2. Immediately thereafter, a corrosion resistant alloy material 25 was spray welded. The alloy material for spray welding was composed of 32% Ni, 21% Cr, 8% Al, 0.5% Y and the remainder of Co. The powder or granule diameter thereof was in the range of 10 to 44 μm. Prior to the spray welding, the member was preheated by using a plasma arc, and then, the spray welding was started in the range of 120° to 160° C. of the preheating temperature. The spray welding condition was such that an $Ar-H_2$ mixture gas plasma was used and an output of the plasma arc was at 40 kW. The member was mounted on a rotary jig and was rotated at a constant rpm. The number of the spray weldings, a pressure of air for purge or the like was selected so that the temperature of the member upon completion of the spray welding was not greater than 180° C. Such a temperature control of the member enabled a formation of a coating 21 having a desired contacting force. A thickness of the coating 21 was about 0.2 mm and an accuracy thereof was ±20 μm. Also, the small cooling air holes 23, as shown in FIG. 3, were spray welded by setting an angle of a plasma torch. It is important to spray weld the small cooling air holes 23 as well as the other parts in order to prevent an effective area of air blow through the small cooling air holes 23 from being reduced due to the oxidation thereof or the like. A thickness of the spray welded layer on the parts around the small cooling air holes 23 would cause a problem in manufacturing and would tend to be about 50% of that on the other parts. Thus, the coating 21 made of alloy material with excellent oxidation resistant characteristics at high temperature and corrosion resistant characteristics at high temperature was formed on the entire surface on the cooling side surface 20*a*. Then, as shown in FIG. 2, the cap ring 26 and a cap cone 27 were connected by being welded to each other, and thereafter, the welding melting process was applied to the members. Subsequently, a coating 30 of $ZrO_2$ was formed on a combustion side surface 29 of the thus produced liner cap 33. Also in this process, the plasma spray welding method was used as a forming method, and the same pre-treatment as in the cooling side surface 20*a* was carried out. The coating 30 was made of $ZrO_2$ consisting of $ZrO_2$-8% $Y_2O_2$. Prior to the spray welding of $ZrO_2$, a spray weld layer of Co-Ni-Cr-Al-Y alloy consisting of the above-described alloy compositions was formed to enhance the coupling force between the spray weld layer of $ZrO_2$ and the member. The spray welding conditions of such a coupling layer were substantially the same as those of the above-described cooling side surface. The thickness of the coupling layer was 0.1±0.02 mm. The spray welding condition was substantially the same as that of the alloy layer which was the coupling layer but the plasma output thereof was 55 kW. Also, the preheating temperature of the member was 120° to 160° C. and the temperature after the completion of the spray welding was not greater than 220° C., as the spray welding condition. With such a spray welding meeting the welding condition, the spray weld layer of $ZrO_2$, having an excellent contactability with the member, was formed. A thickness of the spray weld layer of $ZrO_2$ was 0.2±0.02 mm. Upon manufacturing the liner cap 33, it was important to set the effective area of the small cooling air holes 23 shown in FIG. 3, in advance in view of the thickness of the coating formed on the member, in order to maintain the originally designed air flow amount. As a treatment of corner portions 31 of the small holes 23, the thickness of the coating was zero at the corner portions and gradually increased up to a predetermined thickness. However, at a corner portion 31*a*, the coating was formed also along the plate thickness direction of the cone base member 32 in consideration of peeling of the coating. The thus produced liner cap 33 was incorporated into a low NOx type combustion apparatus liner and a working test of the actual gas turbine was conducted and, for comparison, a liner cap 34 having a conventional structure was tested under similar working condition. The working period of time was about 1,000 hours and about sixty starts and stops were repeated. As a result of the observation of the appearance of the liner cap 34 after the test, in the liner cap having the conventional structure, it was found that cracks 35 were generated between the small cooling air holes 36 as shown in FIGS. 4 and 5. On the other hand, in the liner cap 34 having a structure in accordance with the present invention, there was not any damage such as cracks in the member, and even after removing the coating of the combustion side surface of the liner cap 34 by the blast treatment, there was no damage in the member. Thus, it was found that the liner cap 34 in accordance with the present invention was much superior in durability.

The advantage and effect of the present invention will now be explained with reference to temperature diagrams of FIGS. 6 and 7.

Figure 6:
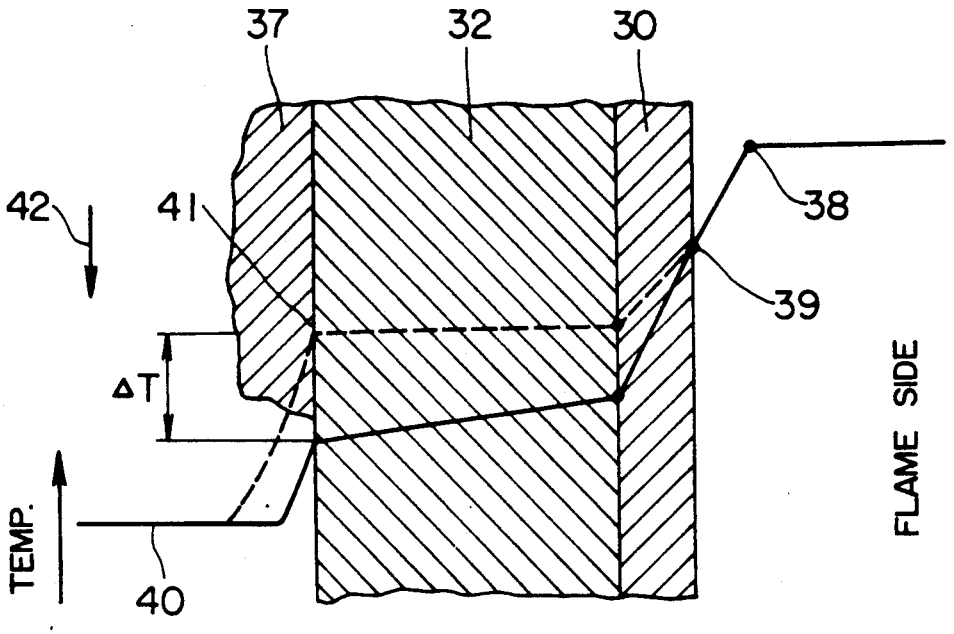
FIGS. 6 and 7 show temperature distributions in the cross-section of the liner cap wall surface taken along the line C-C in FIG. 3.

FIG. 6 shows a state in which a ceramic coating 30 was provided on the flame side alone and an oxidized film 37 was applied locally to the opposite side.

In FIG. 6, where no oxidized film is provided on the cooling side surface of the base 32, the temperature distribution at each part is such that the combustion gas temperature 38 becomes somewhat lower temperature 39 as indicated by solid lines, the temperature was rather lowered within the coating 30 because of low heat conductivity of the coating and the temperature is gradually lowered within the base 32 to approach to some extent a temperature 40 of a cooling air 42 flowing on the opposite side of the base. However, if an adhesive 37 such as an oxidized film is accumulated on the surface of the base 32 by the water spray, then the temperature distribution will be shown by broken lines in FIG. 6. Namely, since the adhesive 37 has a very low heat conductivity as in the coating 30 and the cooling effect of the cooling air 42 degrades, the temperature 41 of the base 32 on the cooling side becomes higher. On the cooling side surface of the base 32, a temperature differential $\Delta T$ is generated between the place where the adhesive 37 is present and the place where the oxidized film is relatively thin. This temperature differential causes a large thermal stress to be generated in the cooling side surface of the base 42, and causes cracks 35 (FIG. 5) to be generated from, for example, sharp corner portions of the cooling air holes. Also, the temperature of the base 42 becomes higher as indicated by broken lines, and the part where the adhesive 37 is present is likely to be excessively heated. In view of this, according to the present invention, as shown in FIG. 7, the alloy material 25 which is superior in corrosion resistant characteristics at high temperature is spray welded on the surface of the base 32 along which the cooling air 42 flows, so that the adhesive 37 is completely prevented from adhering onto the surface of the base 32 to thereby prevent a the generation of the thermal stress in the base 32. The alloy material 25 is made of metallic compositions and has substantially the same heat conductivity as that of the base 32. Assuming that the combustion gas temperature 38 and the surface temperature 39 of the coating 30 are respectively equal to those of the conventional structure, the temperature line 43 is the same as the solid line in FIG. 6 where no adhesive 37 is present. Thus, the prevention of the adhesive 37 from adhering will reduce the thermal stress.

Figure 7:
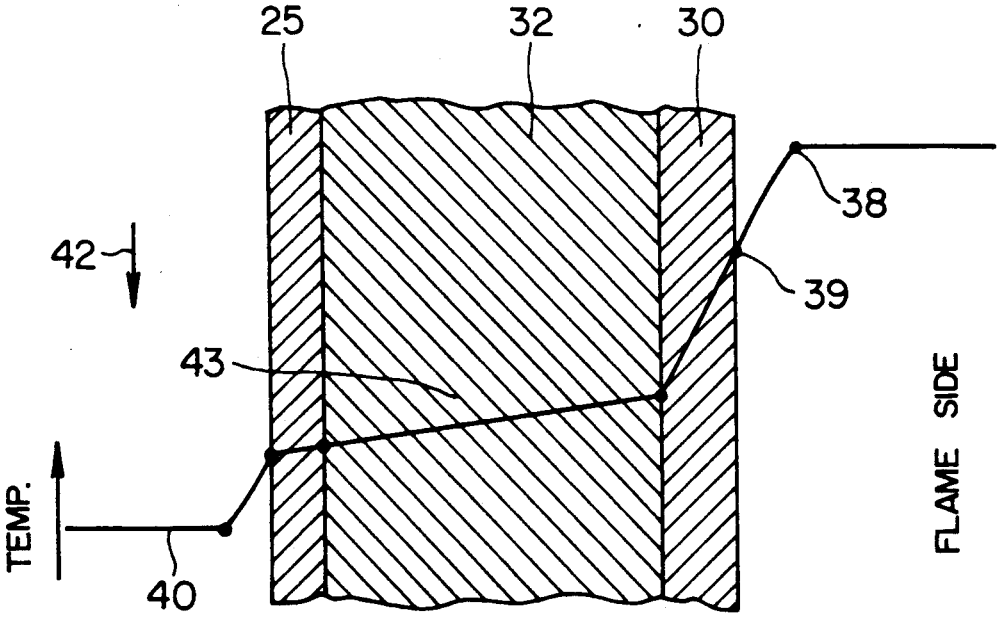

In accordance with the temperature distribution shown in FIG. 7, since the temperature of the base 32 is low and the temperature of the cooling side surface is not locally changed, the thermal stress is suppressed.

On the other hand, in the case where the rear surface of the ceramic coating 30 is cooled with water, a problem of peeling arises.

In order to solve such a problem, various experiments were conducted as to an oxide consisting mainly of $ZrO_2$ and two or three other oxides. While there is no particular limit to the forming method of the coating for the liner cap according to the present invention, it is preferable to employ a high output spray welding method and, in particular, a plasma spray welding method from an economical point of view. Table 1 shows results of the experiments wherein the The coating was formed through the plasma spray welding. As an experimental method, a repeated test of a heat cycle was conducted in which the ceramic coating was held at 800° C. for fifteen minutes and thereafter was dipped into the water at a temperature of 25° C. to 30° C. (for fifteen sec.) and also a repeated test of a heat cycle was conducted in which the coating surface was heated by an oxygen-acetylene mixture gas flame up to 1,000° C. for five secs. and thereafter was cooled (for twenty secs.) by removing the gas flame. In the test using the gas flame, compressed air maintained at room temperature was continuously sprayed onto a rear surface side of the member at a pressure of 3 kg/cm$^2$. In any of the coatings, a metallic alloy layer was interposed between the member and the oxide layer.

TABLE 1

| Material and Composition of Ceramic Coatings | The Number of the Tests Prior to Damaging of the Coating | |
|---|---|---|
| | 800° C. ⟷ water cooling | 1000° C. ⟷ air cooling |
| $ZrO_2$—2% $Y_2O_3$ | 500 | 2000 |
| $ZrO_2$—8% $Y_2O_3$ | 500 | 2000 |
| $ZrO_2$—20% $Y_2O_3$ | 400 | 2000 |
| $ZrO_2$—4% CaO | 400 | 1500 |
| $ZrO_2$—8% CaO | 400 | 1500 |
| $ZrO_2$—8% MgO | 300 | 1500 |
| $ZrO_2$—24% MgO | 300 | 1000 |
| $Al_2O_3$ | 50 | 100 |
| $Al_2O_3$—28% MgO | 50 | 80 |
| $Al_2O_3$—23% $SiO_2$ | 20 | 80 |

Figure 8:
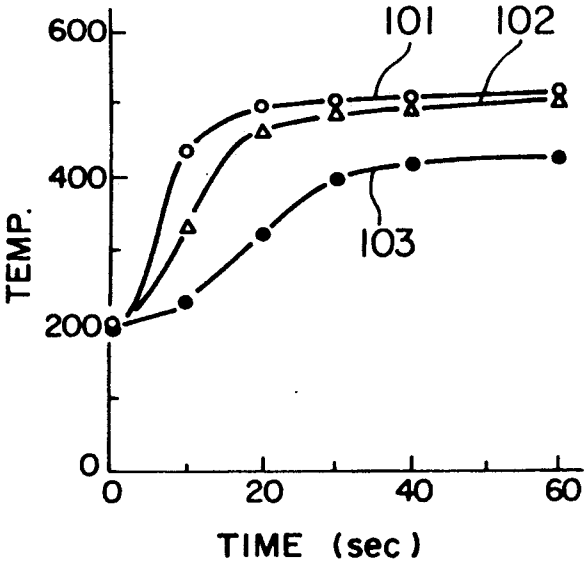
FIGS. 8 through 10 are graphical illustrations of temperature characteristics.

As a result of such heat cycle tests, in any method, the $ZrO_2$ oxides were superior in durability to $Al_2O_3$ oxide. Among the $ZrO_2$ oxides, as a result of reviews of the addition of various kinds of stabilizers, it was found that the addition of $Y_2O_3$ was most excellent. Subsequently, with respect to the members having such ceramic coatings, studies were made as to the temperature change of the members in the case where the thermal shock such as a gas flame was effected. As an experimental method, the surface of the member was abruptly heated by the gas flame, whereupon, the temperature change of the rear surface of the member was measured. Incidentally, the rear surface was cooled by the compressed air as in the former case. As a measurement of the temperature, a CA thermocouple was fused to the part corresponding to the gas flame was measured. One example of the result thereof is shown in FIG. 8. In FIG. 8, reference numeral 101 represents a member to which any ceramic coating was applied, reference numeral 102 represents a member to which an $Al_2O_3$ coating was applied and reference numeral 103 represents a member to which a $ZrO_2$ coating was applied. From the relationship between the temperature of the rear surface of the member and the time, it was apparent that the temperature elevation gradient of the $ZrO_2$ system oxide coated member was most gentle. The results were simulated to the temperature change condition of the member in the case where the combustion gas flame locally approached the combustion side surface of the liner cap. In the case where a $ZrO_2$, oxide having a lower heat conductivity, is applied to the member, even if a rapid thermal change occurs, the temperature change will be vary gentle in comparison with the member having no coating.

Figure 9:
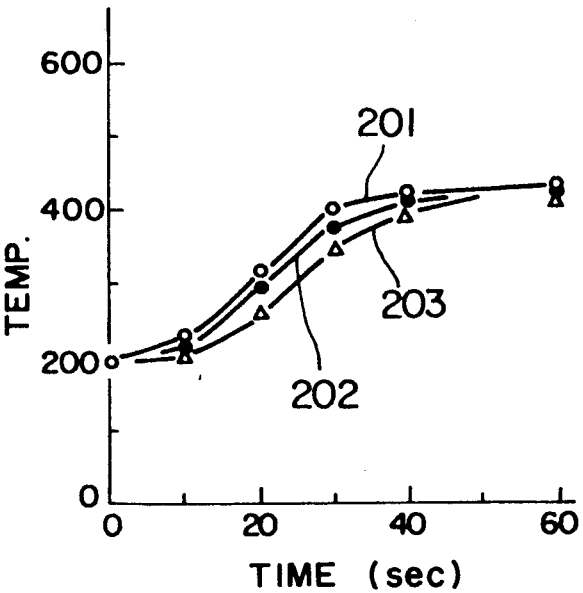
Figure 10:
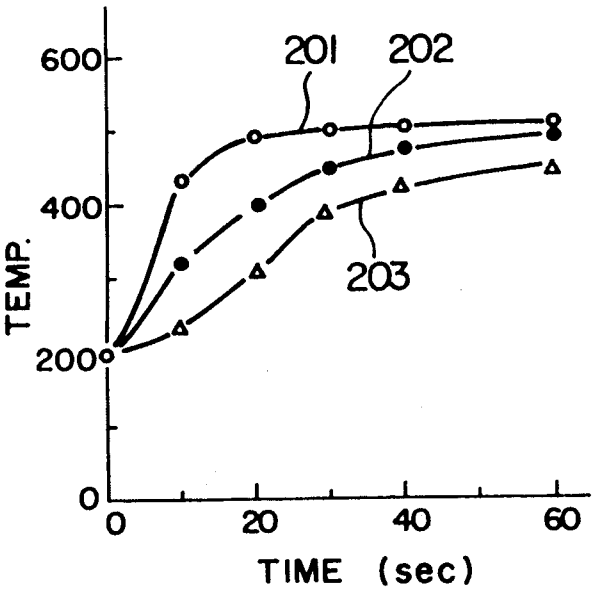

FIGS. 9 and 10 shows results of measurement of the temperature distribution of the rear surface of the member in the same heating manner as in the previous test. FIG. 9 is concerned with the member coated with $ZrO_2$, and FIG. 10 is concerned with the member having no ceramic coating. In either case, a curve 201 represents a temperature of the rear surface portion corresponding to the gas flame, a curve 202 represents a temperature at a part spaced apart from the center of the gas flame by 10 mm, and a curve 203 represent a temperature at a part spaced apart from the center of the gas flame by 20 mm. As is apparent from the results, in the member having no coating, a temperature elevation of the rear surface of the member caused by the ga flame heating remarkably takes place at the restricted part from the heating center. On the other hand, in the member with the $ZrO_2$ oxide coating, the temperature elevation is gentle and the influence of the heating is not concentrated on the center of heating. Form the results, it will be understood that, even if a rapid thermal change is locally generated, it is possible to prevent the local temperature elevation of the member of the liner cap in accordance with the present invention in comparison with the conventional liner cap having no coating. As well as the above-described studies, the influence exerted by the thickness of the coating of ceramic was examined. As a result, it was found that in the liner cap according to the invention, substantially the same results as shown in FIGS. 8 to 10 could be obtained by forming a $ZrO_2$ oxide coating of about 0.1 mm thickness or more. On the other hand, in order to sufficiently maintain the effect of the present invention, as is apparent from the various thermal cycle tests as shown in Table 1, it is preferable that the thickness thereof be less than about 0.5 mm, more preferably, about 0.3 mm. Also, with the liner cap of the present invention, as is apparent from FIGS. 8 to 10, an additional effect, that is, a heat shield effect in which the coating uniformly reduces a temperature of the member as a whole as well known in the art may be expected.

Studies as to the surface treatment of the cooling side surface of the liner cap have been made. In the liner cap according to the present invention, apart from the view of thermal conductivity, since the member is maintained at a high temperature, an influence of corrosive formation due to various impurities contained in the combustion gas, an oxidation of the member surface due to the adhesion of water mixed from the water spray nozzles, and an influence exerted by impurities contained in the water must be sufficiently taken into consideration. In particular, the adhesion of the corrosive formation due to the high temperature oxidation or impurities contained in the combustion gas and the water will adversely affect the cooling effect with the member surface of the cooling side. Further, if such a phenomenon would take place in the small holes or narrow clearances for air cooling, the cooling effect thereat would be degraded. If the cooling effect would be thus reduced, in particular, locally take place, the local temperature elevation of the member would be caused to shorten the service life of the liner cap. According to the present invention, it is, therefore, very important to select material for coatings of the cooling side surface, taking the above-noted defects into consideration. Therefore, studies have been made as to the coatings of various metallic materials having a high thermal conductivity in comparison with ceramic material. High temperature oxidation and high temperature corrosion experiments of various materials have been conducted. The high temperature oxidation experiment was such that test pieces were held at 800° C. for one-hundred hours and the high temperature corrosion experiment was such that the test pieces were held at 760° C. in a molten salt of 25% NaCl - 75% $Na_2SO_4$ for one-hundred hours. In case of metallic materials such as Al, Fe, Ni and the like, from the results of the oxidation and corrosion tests, the coatings were considerably damaged. In case of alloy materials such as Fe-Al, N-Al, Ni-Cr and the like, although the damage appeared small from the visual observation, from the result of observation of the formation in cross-section, an internal damage in each test was found. On the other hand, in case of alloy materials such as Ni-Cr-Al, Co-Cr-Al, Ni-Cr-Al-Y, Co-Cr-Al-Y, Co-Ni-Cr-Al-Y and the like, from results of either appearance observation or internal formation observation, no damage was found in the coatings. As such experimental results, in the liner cap according to the present invention, it is necessary to form coatings of the various alloy system materials which are superior in high temperature oxidation and high temperature corrosion characteristics as described above. However, the present invention is not limited to a specific composition range for the alloy materials. As well as the above-described alloy materials, any alloy system material to which elements such as Ta, Hf, Si and the like are added may be similarly used. The surface treatment effect of the cooling side surface of the liner cap according to the present invention with the coating of alloy material which is superior in high temperature oxidation and high temperature corrosion characteristics has been examined. As a testing manner, the surface of the member coated with a coating was cooled with compressed air, and the surface of the member having no coating was heated by oxygen-acetylene gas flame, and a temperature of the surface on the heated side was measured with a radiation pyrometer. The test was conducted under the constant condition of heating and cooling and the temperature of the member reached an equilibrium at 500° C. Thereafter, water was sprayed on the surface having the coating. At this time, the change of the member temperature with respect to an elapse of time was measured. For comparison, like tests were conducted as to the member having no coating. Incidentally, since a burner for heating having a much greater diameter than that of the water spray nozzle was used, an influence of the temperature distribution was negligible. As a result in the member having no coating, a temperature at a part corresponding to the water spray nozzle rapidly decreased. While, in the member having the coating, a temperature change was gentle. Thus, it was found that in the member coated with the alloy material, even if a local water collision took place, the temperature of the member was hardly changed in a local and rapid manner. As a result of studies of such effects with the thickness of the coating being changed in variety, it was found that the thickness of about 0.1 mm or more was desirable and more preferably, the thickness was about 0.3 mm. Also, if the thickness of the coating was too large, the air cooling effect against the member was reduced, and inversely, the temperature of the member was elevated. Also, in this case, a residual stress generated in the coating upon forming the coating was increased, and damage such, for example, peeling of the coating is generated due to the thermal cycle of repeating the operation and stopping of the gas turbine. Therefore, in view of these defects, and from an economical point of view in forming a ceramic coating, it is preferable that the thickness of the coating be less than 0.5 mm. Based upon the above-described studies, it was experimentally determined that a test piece having a stress concentration portion was made and was provided on its combustion side surface with $ZrO_2$ system oxide and on its cooling side surface with a coating of Ni-Cr-Al-Y alloy, simulating to the effect of the actual liner cap. The test piece was provided in the midportion with a hole in the form of a slit which was 1 mm width and 10 mm long, so that a stress would be concentrated on its corner portions. The test piece was heated by the above-described gas flame and was cooled by compressed air. The water spray was applied in the same manner as described above. As the temperature change of the member, the temperature on the cooling side surface was measured. After the temperature of the cooling side surface of the member reached the equilibrium at 700° C., the water spray was supplied to the corner portions of the slit hole from a nozzle having a diameter of 5 mm, for thirty secs. Then, the water spray was stopped and the gas flame was moved apart from the test piece and cooled. Such a cycle was repeated. As a result, in the piece having no coating, a crack was generated at the corner portion of the slit by eighty repeated cycles. On the other hand, in the test piece having coatings on both surfaces of the cooling and combustion sides, even after about five-hundred repeated cycle tests, no damage was found in the test piece by observation or cross-sectional inspection. Incidentally, in the test piece having a coating on either the combustion side surface or the cooling side surface, a crack was generated by about one-hundred fifty cyclic tests. Thus, according to the liner cap of the present invention, the effect of the combustion and cooling sides were combined with each other, so that a remarkable resultant effect could be obtained. Therefore, in the liner cap according to the present invention, it is necessary to provide coatings on both sides. Such a method of forming the coatings have already been explained. As the effect of the use of the plasma spray welding for forming the coating on the cooling side surface, there is an advantage in that the coating becomes a high density coating to reduce a thermal resistance degrading the air cooling effect, and a corrugation in order of several microns on the coating surface which in inherent in the spray welded layer may increase an effective surface area for the air cooling. Furthermore, such an corrugations may serve to diffuse an energy of water collision and reduce the influence thereof.

The present invention has been described with reference to the shown embodiment but is not limited thereto. The present invention is applicable to the liner sleeve body 5. In case of the application of the invention to the sleeve body, there is an advantage in that when the gas turbine is installed in a coastal area, salt components are included in cooling air and the sleeve body 5 is likely to be corroded in such an ambient atmosphere, however, such corrosion may be prevented.

As described above, according to the present invention, since a ceramic coating is provided on a surface on the flame radiation side, a temperature elevation may be suppressed, and since a coating made of corrosion resistant material is applied to the rear surface, it is possible to prevent adhesives of lower heat conductivity from being formed, whereby a generation of a crack may be prevented.

We claim:

1. A combustion apparatus comprising:

a liner cap means for closing an open end of a liner sleeve body of the combustion apparatus, the liner cap means including a first member having a plurality of cooling air holes therein and having formed on a first surface thereof, which is adapted to be subjected to flame radiation heat, a ceramic coating for thermally protecting said first member from flame radiation heat to which it is to be subjected, and having formed on a second surface thereof, opposite said first surface thereof, a corrosion resistant metal material, the heat conductivity of which is relatively high compared with said ceramic coating;

a fuel nozzle coupled with said liner cap means for supplying fuel through the combustion of which said liner cap means is subjected to flame radiation heat; and wherein said liner cap means further comprises an outer sleeve surrounding said first member for defining an air passage with said first member and an end plate of said liner cap means.

2. A combustion apparatus according to claim 1, wherein said first member includes a cone shaped metallic member.

3. A combustion apparatus according to claim 2, further comprising a collar means surrounding said fuel nozzle and having said end plate and said cone shaped metallic member affixed thereto.

4. A combustion apparatus according to claim 1, wherein said ceramic coating is comprised essentially of $ZrO_2$.

5. A combustion apparatus according to claim 1, wherein said corrosion resistant material is made of Ni-Cr-Al-Y or Co-Cr-Al-Y alloy.

* * * * *